US012458163B2

(12) United States Patent
Waxley

(10) Patent No.: US 12,458,163 B2
(45) Date of Patent: Nov. 4, 2025

(54) CLOTHING HANGER STORAGE SYSTEM

(71) Applicant: Robyn Waxley, Bossier City, LA (US)

(72) Inventor: Robyn Waxley, Bossier City, LA (US)

( * ) Notice: Subject to any disclaimer, the term of this patent is extended or adjusted under 35 U.S.C. 154(b) by 12 days.

(21) Appl. No.: 18/045,648

(22) Filed: Oct. 11, 2022

(65) Prior Publication Data

US 2023/0148777 A1 May 18, 2023

Related U.S. Application Data

(60) Provisional application No. 63/280,654, filed on Nov. 18, 2021.

(51) Int. Cl.
*A47G 25/14* (2006.01)

(52) U.S. Cl.
CPC ..... *A47G 25/1464* (2013.01)

(58) Field of Classification Search
CPC ..... A47G 25/1464; A47G 25/1442
USPC ..... 206/300
See application file for complete search history.

(56) References Cited

U.S. PATENT DOCUMENTS 5,427,230 A * 6/1995 Mattox ..... A45C 11/16 206/478
5,515,981 A * 5/1996 Gregory ..... A47G 25/1457 211/89.01
5,628,398 A * 5/1997 Jackson ..... A45C 3/004 190/110
2007/0119881 A1* 5/2007 Murphy ..... A47G 25/743 223/97
2012/0024727 A1* 2/2012 Dragan ..... A45C 13/03 383/42
2018/0279774 A1* 10/2018 Delta ..... A47B 47/0058
2020/0205594 A1* 7/2020 Wingard ..... A47G 25/1464

FOREIGN PATENT DOCUMENTS

CN 101731906 A * 6/2010 ..... A47G 25/00
GB 2440450 A * 1/2008 ..... A47G 25/1442
GB 2459830 A * 11/2009 ..... A47G 25/1457
JP 2000342425 A * 12/2000 ..... A47G 25/28
WO WO2001080694 A1 * 11/2001 ..... A47G 25/06

* cited by examiner

*Primary Examiner* — Anthony D Stashick
*Assistant Examiner* — Marcos Javier Rodriguez Molina
(74) *Attorney, Agent, or Firm* — Brennan, Manna & Diamond, LLC

(57) ABSTRACT

The present invention relates to a multipurpose storage rack for storing unused or idle clothing hangers. The rack is configured to store a plurality of clothing hangers while minimizing storage space and features a felt print fabric, available in various styles and colors, measuring, for example, 12-inches wide and 58-inches long. The top end of the fabric has a hanger for hanging the fabric on any wall-mounted hook or rod. Further, the fabric has a multitude of pairs of symmetrical hooks for supporting idle hangers in an upside-down orientation wherein each pair, in one exemplary embodiment, can accommodate up to 10 hangers. The hooks can be sewn into the fabric or can be attached to a rod positioned inside the loops of the fabric.

14 Claims, 4 Drawing Sheets

CLOTHING HANGER STORAGE SYSTEM

CROSS-REFERENCE TO RELATED APPLICATION

The present application claims priority to, and the benefit of, U.S. Provisional Application No. 63/280,654, which was filed on Nov. 18, 2021, and is incorporated herein by reference in its entirety.

FIELD OF THE INVENTION

The present invention relates generally to the field of clothing hangers. More specifically, the present invention relates to a novel storage device for efficient storage of unused clothing hangers. The storage device is in the form of a felt fabric having an attached hanger at the top end thereof for hanging the fabric on a wall-mounted hook. The device has a plurality of pairs of hooks for supporting clothing hangers thereon. The pairs of hooks support the hangers in upside down position and can accommodate, in one exemplary arrangement, up to 40 hangers. Accordingly, the present disclosure makes specific reference thereto. Nonetheless, it is to be appreciated that aspects of the present invention are also equally applicable to other like applications, devices, and methods of manufacture.

BACKGROUND

By way of background, garments such as shirts, pants, blazers, jump suits and more are stored in a closet. Commonly, each garment is placed on a hanger and is hung on a rod within the closet. A hanger, also referred to as a clothing hanger or coat hanger is a device contoured like human shoulders which is used for storing clothing in a designated area such as a closet. A hanger enables the users to quickly access their clothing and helps in storing clothing without a wrinkle. Almost all the hangers come with a lower horizontal bar extending across the shoulder contoured portions for hanging pants/trousers, skirts, and more. Hangers are also used for additional purposes such as for drying the clothing and for removing wrinkles from clothing by exposing them to a steam bath.

With the ever-increasing number of clothing for individuals, space in a closet becomes inadequate to store hangers when they are not used for hanging clothing. Hangers are generally stored in unusual places or hard-to-reach places when not used so that space in closet becomes free. Hangers when not used can get damaged when placed on a surface. Many times, individuals may scatter their hangers on the floor, risking them to being stepped on and broken. Sometimes, hanger stackers configured to pack hangers in a stack are used by individuals, but hanger stackers are expensive and consume space. As a result, individuals desire an effective way of storing hangers when they are not used for hanging clothing such that space in closet for storing hangers is minimized and organized.

Therefore, there exists a long-felt need in the art for a multipurpose storage rack for storing clothing hangers. There is also a long-felt need in the art for a clothing hanger storage rack that prevents excess or unused hangers from being thrown on the floor. Additionally, there is a long-felt need in the art for a clothing hanger storage device that prevents hangers from being stored in unusual places. Moreover, there is a long-felt need in the art for a device that offers a convenient storage area for clothing hangers when hangers are not in use. Further, there is a long-felt need in the art for a clothing hanger storage device that obviates the requirement of storing unused hangers in a closet. Furthermore, there is a long-felt need in the art for a clothing hanger storage device that can be easily hung or stored at a convenient and easily accessible area without taking up considerable space. There is a long-felt need in the art for a clothing hanger storage device that safely stores unused hangers and protects them from physical damage. Finally, there is a long-felt need in the art for a clothing hanger storage device that saves significant time, effort, and space when storing unused clothing hangers.

The subject matter disclosed and claimed herein, in one embodiment thereof, comprises a multipurpose storage device for unused clothing hangers. The storage device, in one embodiment, is designed to store up to 40 hangers in an easily accessible form thereby minimizing storage space and scattering of unused hangers. The storage device features a felt print fabric measuring, for example, about 12-inches wide by 58-inches long, having a top end, a bottom end, and a pair of opposing side edges. A durable hanger is integrally attached to the top end for hanging the felt print fabric on a wall mounted hook or hanger rod, four pairs of hooks are fastened on the fabric for supporting clothing hangers, the pair of hooks are vertically equidistant from each other such that longest or hypotenuse arm of the clothing hangers is positioned on a pair of hooks allowing the side arms of the hangers to hang for securely storing the clothing hangers.

In this manner, the clothing hanger storage device of the present invention accomplishes all of the forgoing objectives and provides users with a multipurpose storage rack for clothing hangers that supports a plurality of clothing hangers offering a convenient storage area for the hangers when not in use. The device has a plurality of pairs of hooks for holding up a plurality of hangers, thereby saving significant time, space, and effort in storing unused hangers. The device can be hung on the back of a closet door or on the clothes rod or rack in the closet without taking up considerable space.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multipurpose storage device for clothing hangers. The storage device, in one embodiment, is designed to store up to 40 hangers in an easily accessible form when hangers are not used for hanging clothing. The storage device further comprising a felt print fabric measuring, in one example, generally 12-inches wide by 58-inches long, the fabric is generally rectangular, having a top end, a bottom and a pair of opposing side edges, a durable hanger integrally attached to the top end for hanging the felt print fabric on a wall mounted hook or clothes rod, a plurality of pairs of hooks for supporting clothing hangers, each pair of hooks is fastened to a fabric loop positioned on the fabric, the pair of hooks are vertically equidistant from each other such that hypotenuse arm of the clothing hangers are positioned on a pair of hooks allowing the side arms of the hangers to hang for securely storing the clothing hangers. Each pair of hooks, in one embodiment, can store up to 10 hangers for easy storage and accessibility.

In yet another embodiment, a multifunctional storage unit for clothing hangers is disclosed. The storage unit can be hung on the back of a closet door or on the clothes rod or rack in the closet without taking up considerable space for storing a plurality of idle clothing hangers. The storage unit includes a multitude of aligned pairs of hooks sewn to a generally rectangular felt fabric, a first pair of hooks is positioned at a first distance (i.e., 8-inches) from a top end of the fabric, a second pair of hooks is positioned at a second distance (i.e., 15-inches) from the first pair of hooks, a third pair of hooks is positioned at a third distance (i.e., 15-inches) from the second pair of hooks, a fourth pair of hooks is positioned at a fourth distance (i.e., 15-inches) from the third pair of hooks, each pair of hooks are fastened to a rod placed in a loop positioned at said positions where the pairs of hooks are positioned, a hanger integrally attached to the top end of the fabric for hanging the fabric to a hook or rod. Each pair of hooks is used for accommodating and supporting clothing hangers in unused or idle state by supporting the hypotenuse arm placed on the hooks such that the side arms hang down below the hooks.

In yet another embodiment, a method for storing unused clothing hangers is described. The method includes the steps of providing a storage device, the storage device includes a multitude of pairs of U-shape hooks attached to a rectangular felt fabric, each pair includes two horizontally coplanar U-shape hooks, a hanger attached to the top end of the fabric for hanging the device on a wall-mounted hook or clothes rod; orienting a clothing hanger upside down, placing horizontal or hypotenuse arm of the clothing hanger on a pair of hooks such that the horizontal arm is supported by the pair of hooks and the side arms hang below the hooks. A plurality of clothing hangers are stored on each pair of hooks such that hangers supported by one pair of hooks do not touch the hangers supported by any other pair of hooks.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
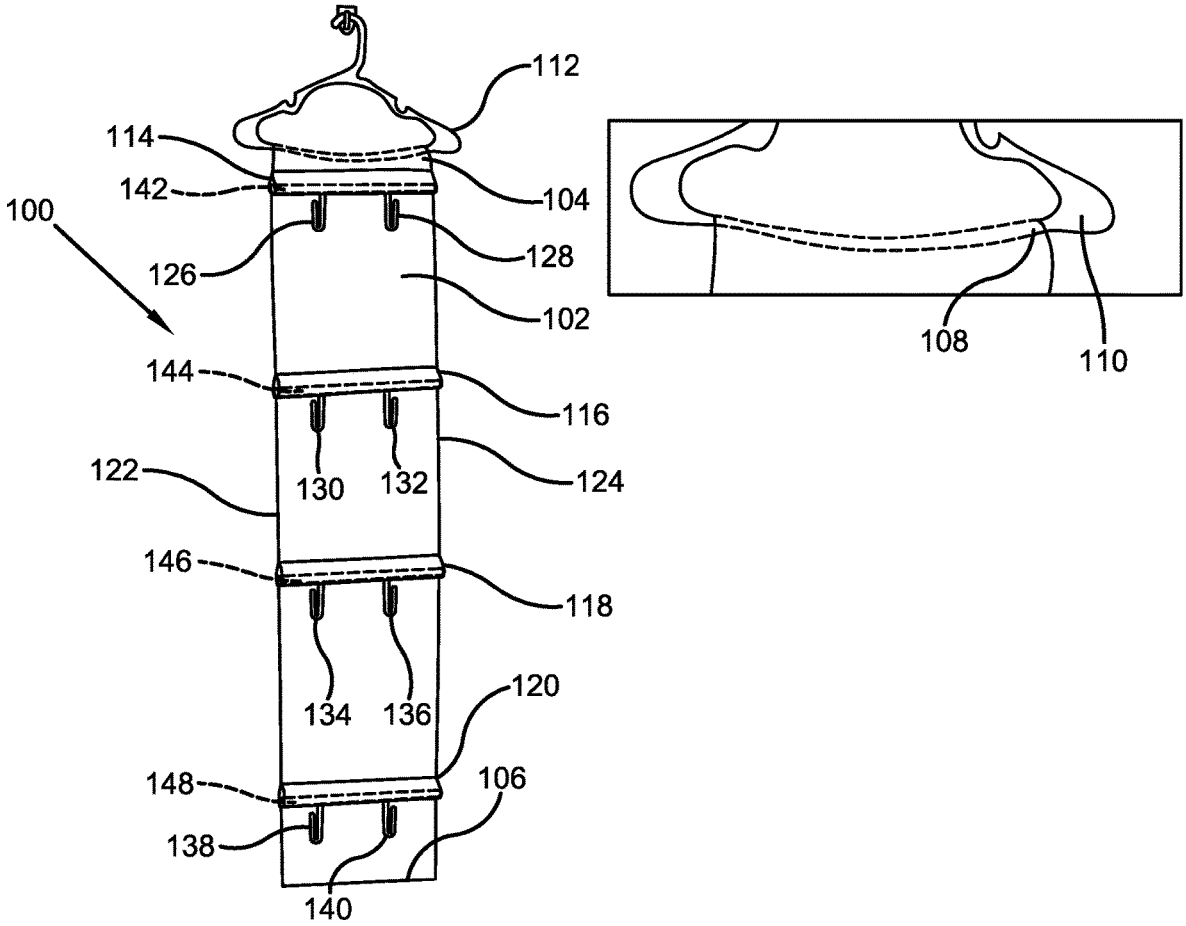
FIG. 1 illustrates a perspective view of one potential embodiment of a clothing hanger storage device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a multipurpose storage rack for storing idle clothing hangers. There is also a long-felt need in the art for a clothing hanger storage rack that prevents excess, idle, or unused hangers from being thrown on the floor. Additionally, there is a long-felt need in the art for a clothing hanger storage device that prevents hangers from being stored in unusual places. Moreover, there is a long-felt need in the art for a device that offers a convenient storage area for clothing hangers when hangers are not in use. Further, there is a long-felt need in the art for a clothing hanger storage device that obviates the requirement of storing unused hangers in a closet or on a clothes rod. Furthermore, there is a long-felt need in the art for a clothing hanger storage device that can be easily hung or stored at a convenient and easily accessible area without taking up considerable space. There is a long-felt need in the art for a clothing hanger storage device that safely stores unused hangers and protects them from physical damage. Finally, there is a long-felt need in the art for a clothing hanger storage device that saves significant time, effort, and space when storing unused clothing hangers.

The present invention, in one exemplary embodiment, is a multifunctional storage unit for unused clothing hangers. The storage unit can be hung on the back of a closet door or on the clothes rod or rack in the closet without taking up considerable space for storing a plurality of idle clothing hangers. The storage unit efficiently stores the hangers in an easily accessible form. The storage unit includes a multitude of aligned pairs of hooks sewn to a generally rectangular felt fabric, a first pair of hooks is positioned at a first distance (i.e., 8-inches) from a top end of the fabric, a second pair of hooks is positioned at a second distance (i.e., 15-inches) from the first pair of hooks, a third pair of hooks is positioned at a third distance (i.e., 15-inches) from the second pair of hooks, a fourth pair of hooks is positioned at a fourth distance (i.e., 15-inches) from the third pair of hooks, each pair of hooks are fastened to a rod placed in a loop positioned at said positions where the pairs of hooks are positioned, a hanger integrally attached to the top end of the fabric for hanging the fabric to a hook or rod. Each pair of hooks is used for accommodating and supporting clothing hangers in unused or idle state by supporting the hypotenuse arm placed on the hooks such that the side arms hang down below the hooks.

Referring initially to the drawings, FIG. 1 illustrates a perspective view of one potential embodiment of clothing hanger storage device of the present invention in accordance with the disclosed architecture. The clothing hanger storage device 100 of the present embodiment is designed as an improved, convenient storage unit for clothing hangers. The device 100 is flexible and is made of a substantially rectangular felt print or flexible fabric 102 preferably measuring about 12-inches wide by 58-inches long. The fabric 102 has a top end 104 and a bottom end 106 wherein the top end 104 has a continuous fabric loop 108 through which a lower arm 110 of a durable and sturdy hanger 112 is passed therethrough. The hanger 112 is integrally attached to the felt or flexible fabric 102 and is configured to hang on a wall mounted hook or from a clothes rod for easily storing the storage device 100 without occupying much space.

The felt or flexible fabric 102 has four parallel and equidistant loops 114, 116, 118, 120 extending from one side edge 122 to another side edge 124 of the fabric 102 such that each loop includes a pair of fastened hooks for supporting a plurality of clothing hangers for easy storage and accessibility. As illustrated, the first loop 114 has a pair of fastened hooks 126, 128, the second loop 116 has a pair of fastened hooks 130, 132, the third loop 118 has a pair of fastened hooks 134, 136, and the fourth loop 120 has a pair of fastened hooks 138, 140. Each hook comprises a substantially U-shape or C-shape and is attached to the respective loop such that the hook is securely and stably positioned. Each pair of hooks can be individually fastened or sewn to the loop or can be attached to a horizontal rod placed in the loop. As illustrated, the hooks 126, 128 are attached to the rod 142, the hooks 130, 132 are attached to the rod 144, and similarly, the hooks 134, 136 are attached to the rod 146, and the hooks 138, 140 are attached to the rod 148.

Figure 2:
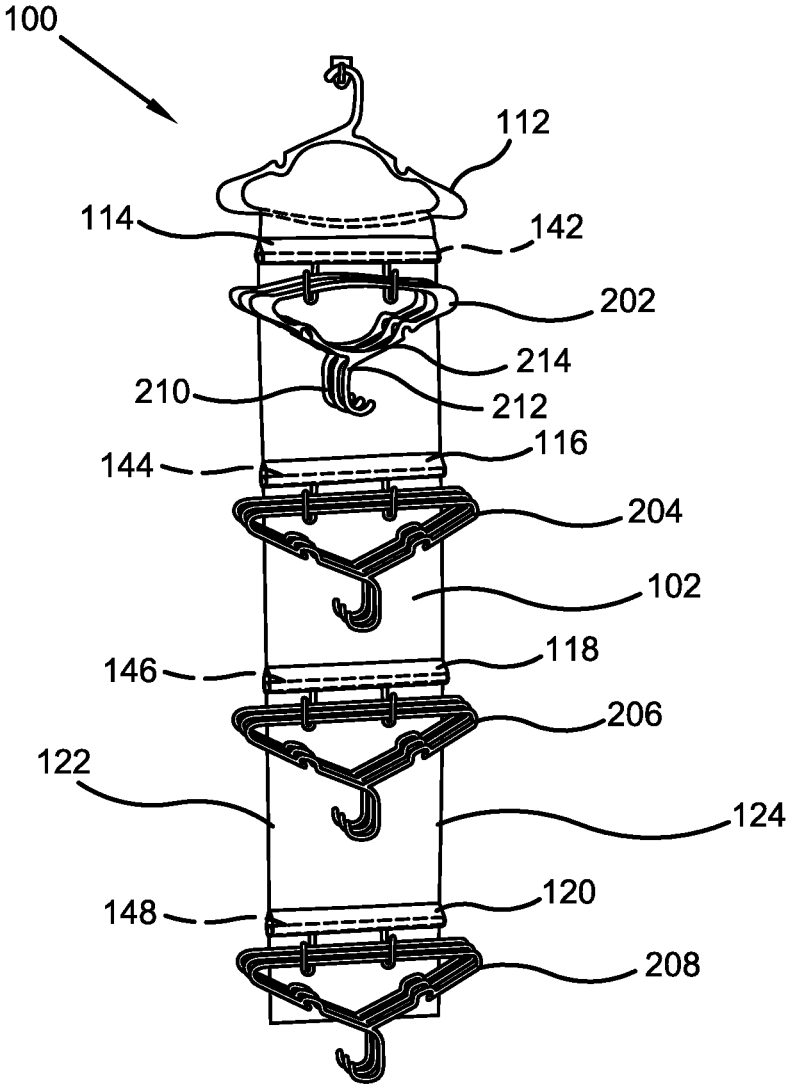
FIG. 2 illustrates a perspective view showing the clothing hanger storage device supporting a plurality of the unused or idle hangers for easy storage and accessibility in accordance with the disclosed architecture.

The hooks 126, 130, 134, 138 are preferably aligned vertically and the hooks 128, 132, 136, 140 are aligned vertically for maintaining balance of the device 100. The hooks are preferably made of lightweight plastic or non-corrosive metal or alloy. All the hooks are substantially of the same shape and size and each pair of hooks fastened to a common loop are used for hanging and supporting unused or idle hangers as illustrated in FIG. 2. The felt or flexible fabric 102 can be of any design and shape and the hanger 112 enables the storage device 100 to easily store on the back of a closet door or on the clothes rod or rack in the closet without taking up considerable space.

FIG. 2 illustrates a perspective view showing the clothing hanger storage device supporting a plurality of the unused hangers for easy storage and accessibility in accordance with the disclosed architecture. Each pair of hooks is configured to support a plurality of hangers for easy storage such that the hangers are not scattered on the floor nor do they consume undue space in a closet or any other area. Further, the pair of hooks are configured to support clothing hangers of different sizes and shapes. As illustrated, the four pair of hooks are independently and separately used for storing a plurality of clothing hangers 202, 204, 206, 208. For supporting a clothing hanger such as one of the hangers 210 on the first pair of hooks 126, 128, the clothing hanger is positioned in an inverted position by turning the hanger in an upside-down position such that the horizontal or hypotenuse arm of the hanger is positioned on the pair of hooks 126, 128 while the side arms 214 hang downward. Vertical distance between each pair of hooks is such that the clothing hanger hook 212 does not touch the loop 116 therebelow.

Each pair of hooks can support, for example, up to 10 clothing hangers, thus providing convenient storage area of hangers when not in use. Further, the weight of the clothing hangers is evenly distributed along the length of the felt or flexible fabric 102 such that the stored hangers are not misplaced nor dropped from the storage device 100.

Figure 3:
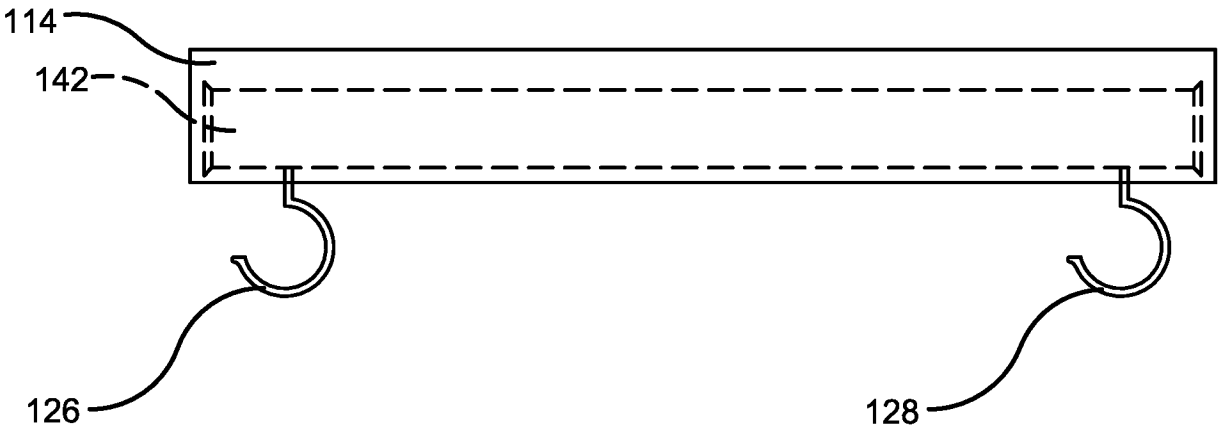
FIG. 3 illustrates a perspective view showing arrangement of the hooks in a loop of the felt fabric for supporting clothing hangers in accordance with the disclosed architecture.

FIG. 3 illustrates a perspective view showing arrangement of the hooks in a loop of the felt fabric for supporting clothing hangers in accordance with the disclosed architecture. As illustrated, the loop 114 has the rod 142 positioned therein with the rod 142 having the hooks 126, 128 removably attached thereto. The hooks 126, 128 extend out of the loop 114 and the curved portion of the hooks support the clothing hangers.

In some embodiments, the rods may not be positioned inside the respective loops and the hooks may be sewn directly to the loops. The loops do not allow the fabric to shrink or drop when a plurality of hangers are positioned on the hooks connected to the loops.

Figure 4:
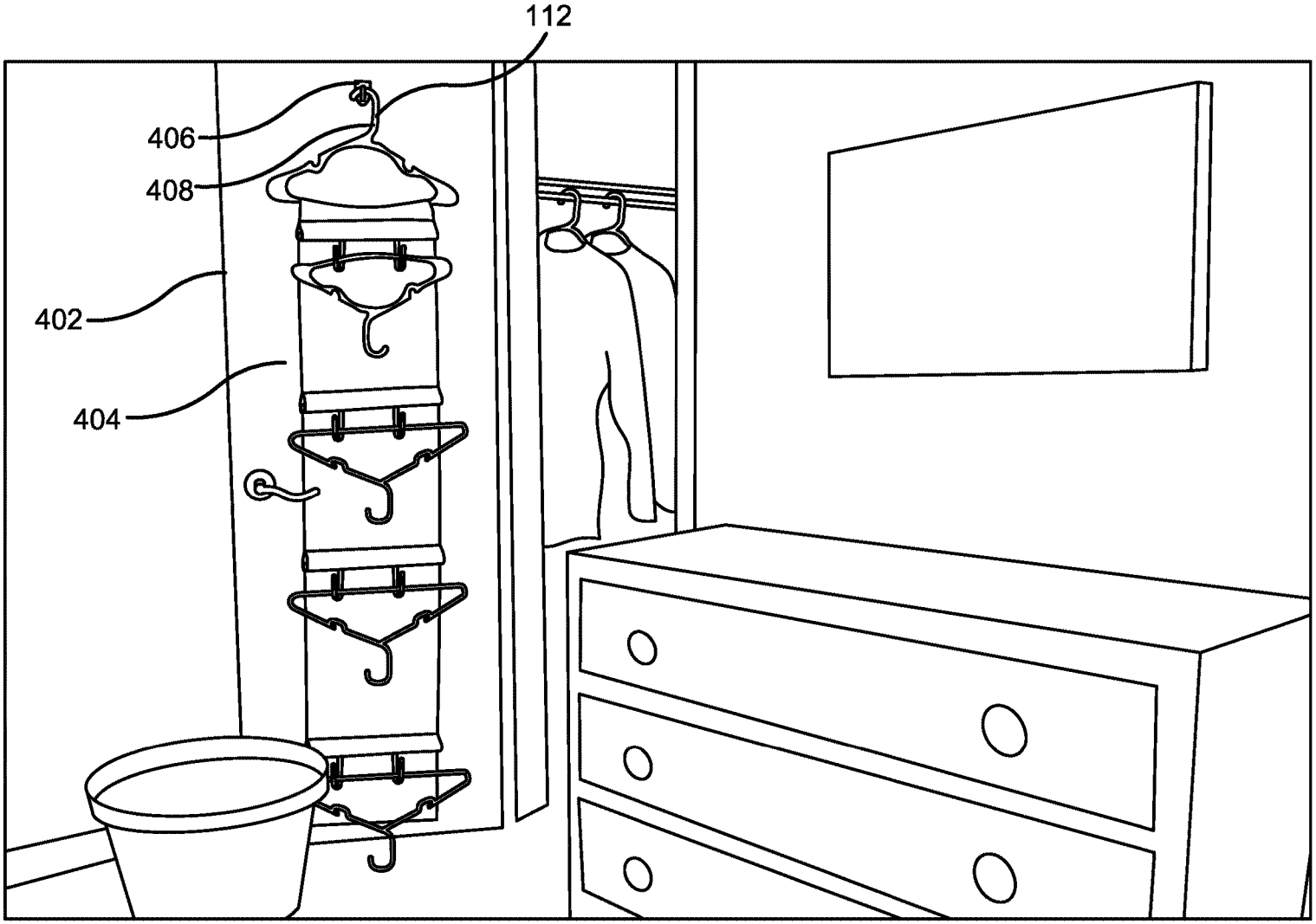
FIG. 4 illustrates a perspective view showing the clothing hanger storage system stored at the back of a closet door in accordance with the disclosed architecture.

FIG. 4 illustrates a perspective view showing the clothing hanger storage system stored at the back of closet door in accordance with the disclosed architecture. The storage system 100 can be easily stored at any convenient place for securely storing unused/idle hangers and for easily accessing them. As illustrated, the device 100 is stored at the back surface 404 of a closet door 402 on a wall-mounted hook 406 using the hanger 112. The swivel hook 408 of the hanger 112 is engaged to the hook 406 for securely hanging the device 100 such that all the felt or flexible fabric 102 remains close to the back surface 404 of the door 402 and the hangers 202, 204, 206, 208 remain easily accessible as illustrated in FIG. 2.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "clothing hanger storage device", "clothing hanger storage rack", "clothing hanger storage system", "device", and "storage device" are interchangeable and refer to the clothing hanger storage device 100 of the present invention.

Notwithstanding the forgoing, the clothing hanger storage device 100 of the present invention can be of any suitable size and configuration as is known in the art without affecting the overall concept of the invention, provided that it accomplishes the above-stated objectives. One of ordinary skill in the art will appreciate that the clothing hanger storage device 100 as shown in the FIGS. are for illustrative purposes only, and that many other sizes and shapes of the clothing hanger storage device 100 are well within the scope of the present disclosure. Although the dimensions of the clothing hanger storage device 100 are important design parameters for user convenience, the clothing hanger storage device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A clothing hanger storage device comprising:

a hanger storage device comprising a felt print having a top end, a bottom end, a first side edge, and a second opposing side edge;

a plurality of loops attached to said felt print between said top end and said bottom end;

a first loop proximal to said top end having a fixed hanger disposed within the first loop and integrally attached to the felt print;

a second loop having a rod therethrough extending substantially from said first side edge to said second side edge;

a third loop having another rod therethrough extending substantially from said first side edge to said second side edge;

wherein said fixed hanger having a hook for hanging said hanger storage device therefrom;

wherein said rod and said another rod each having a pair of fastened hooks for supporting a plurality of clothing hangers therefrom;

wherein the first loop is a continuous fabric loop extending continuously between the first and second side edges and retains a lower arm of the fixed hanger that is integrally attached to the felt print within the first loop; and wherein each fastened hook is a non-corrosive metal hook that is removably attachable to the respective rod and extends through penetrating the respective loop; and wherein a first pair of the pair of fastened hooks is positioned eight inches from the top end of the felt print and a second pair of the pair of fastened hooks is positioned fifteen inches below the first pair of fastened hooks.

2. The clothing hanger storage device of claim 1, wherein said felt print is rectilinear having a width about 12-inches and a length about 58-inches.

3. The clothing hanger storage device of claim 1 further comprising a fourth loop having a rod therethrough and a fifth loop having a rod therethrough, wherein said fourth loop rod and said fifth loop rod each having a pair of fastened hooks for supporting a plurality of clothing hangers therefrom.

4. The clothing hanger storage device of claim 3, wherein each fastened hook having a substantially U-shape such that said each pair of fastened hooks support a horizontal arm of each of said plurality of clothing hangers.

5. The clothing hanger storage device of claim 3, wherein each fastened hook having a substantially C-shape such that said each pair of fastened hooks support a horizontal arm of each of said plurality of clothing hangers.

6. The clothing hanger storage device of claim 4, wherein each of said plurality of clothing hangers are supported in an upside-down position.

7. A clothing hanger storage device comprising:

a hanger storage device comprising a felt print having a top end, a bottom end, a first side edge, and a second opposing side edge;

a plurality of loops attached to said felt print between said top end and said bottom end;

a first loop proximal to said top end having a fixed hanger disposed within the first loop and integrally attached to the felt print;

a second loop having a pair of fastened hooks for supporting a plurality of clothing hangers therefrom;

a third loop having a pair of fastened hooks for supporting a plurality of clothing hangers therefrom;

wherein said fixed hanger having a hook for hanging said hanger storage device therefrom;

wherein the first loop is a continuous fabric loop extending continuously between the first and second side edges and retains a lower arm of the fixed hanger that is integrally attached to the felt print within the first loop; and wherein each fastened hook is sewn to the respective loop; and wherein the pair of fastened hooks of the second loop is positioned eight inches from the top end of the felt print and the pair of fastened hooks of the third loop is positioned fifteen inches below the pair of fastened hooks of the second loop.

8. The clothing hanger storage device of claim 7, wherein said felt print is rectilinear having a width about 12-inches and a length about 58-inches.

9. The clothing hanger storage device of claim 7 further comprising a fourth loop having a pair of fastened hooks for supporting a plurality of clothing hangers therefrom and a fifth loop having a pair of fastened hooks for supporting a plurality of clothing hangers therefrom.

10. The clothing hanger storage device of claim 9, wherein each fastened hook having a substantially U-shape such that said each pair of fastened hooks support a horizontal arm of each of said plurality of clothing hangers.

11. The clothing hanger storage device of claim 9, wherein each fastened hook having a substantially C-shape such that said each pair of fastened hooks support a horizontal arm of each of said plurality of clothing hangers.

12. The clothing hanger storage device of claim 10, wherein each said fastened hook is a lightweight plastic hook or a non-corrosive metal hook.

13. The clothing hanger storage device of claim 10, wherein each of said plurality of clothing hangers are supported in an upside-down position.

14. A clothing hanger storage device comprising:

a hanger storage device comprising a felt print having a top end, a bottom end, a first side edge, and a second opposing side edge;

a first loop proximal to said top end having a fixed hanger disposed within the first loop and integrally attached to the felt print;

a first pair of fastened hooks for supporting a plurality of clothing hangers therefrom;

a second pair of fastened hooks for supporting a plurality of clothing hangers therefrom;

a third pair of fastened hooks for supporting a plurality of clothing hangers therefrom; and a fourth pair of fastened hooks for supporting a plurality of clothing hangers therefrom; and wherein said fixed hanger having a swivel hook for hanging said hanger storage device therefrom;

wherein the first loop is a continuous fabric loop extending continuously between the first and second side edges and retains a lower arm of the fixed hanger that is integrally attached to the felt print within the first loop; and wherein each fastened hook is a U-shaped hook that is to the felt print; and wherein the first pair of fastened hooks is positioned eight inches from the top end of the felt print, the second pair of fastened hooks is positioned fifteen inches below the first pair of fastened hooks, the third pair of fastened hooks is positioned fifteen inches below the second pair of fastened hooks, and the fourth pair of fastened hooks is positioned fifteen inches below the third pair of fastened hooks.

* * * * *